US006950373B2

(12) United States Patent
Butler et al.

(10) Patent No.: US 6,950,373 B2
(45) Date of Patent: Sep. 27, 2005

(54) MULTIPLY RESONANT WIDEBAND TRANSDUCER APPARATUS

(75) Inventors: Alexander L. Butler, Milton, MA (US); John L. Butler, Cohasset, MA (US)

(73) Assignee: Image Acoustics, Inc., Cohasset, MA (US)

( * ) Notice: Subject to any disclaimer, the term of this patent is extended or adjusted under 35 U.S.C. 154(b) by 67 days.

(21) Appl. No.: 10/438,615

(22) Filed: May 16, 2003

(65) Prior Publication Data

US 2004/0228216 A1 Nov. 18, 2004

(51) Int. Cl.[7] ..... H04R 17/00

(52) U.S. Cl. ..... 367/158; 367/162; 367/176; 310/320; 310/323.01; 310/328

(58) Field of Search ..... 310/311, 320, 310/323.01, 328, 334, 336, 327, 337; 367/162, 176, 158

(56) References Cited

U.S. PATENT DOCUMENTS

| | | | | |
|---|---|---|---|---|
| 3,378,814 A | | 4/1968 | Butler | |
| 3,845,333 A | | 10/1974 | Holloway | |
| 3,924,259 A | | 12/1975 | Butler et al. | |
| 4,326,275 A | | 4/1982 | Butler | |
| 4,438,509 A | | 3/1984 | Butler et al. | |
| 4,443,731 A | | 4/1984 | Butler et al. | |
| 4,604,542 A | * | 8/1986 | Thompson | 310/334 |
| 4,633,119 A | * | 12/1986 | Thompson | 310/334 |
| 4,642,802 A | | 2/1987 | Butler et al. | |
| 4,742,499 A | | 5/1988 | Butler | |
| 4,752,918 A | * | 6/1988 | Boucher et al. | 310/337 |
| 4,754,441 A | | 6/1988 | Butler | |
| 4,811,307 A | * | 3/1989 | Pohlenz et al. | 310/337 |
| 4,845,688 A | | 7/1989 | Butler | |
| 4,864,548 A | | 9/1989 | Butler | |
| 5,047,683 A | | 9/1991 | Butler et al. | |
| 5,081,391 A | | 1/1992 | Owen | |
| 5,184,332 A | | 2/1993 | Butler | |
| 5,742,561 A | | 4/1998 | Johnson | |
| 5,957,851 A | * | 9/1999 | Hossack | 600/459 |
| 6,465,936 B1 | | 10/2002 | Knowles et al. | |
| 6,643,222 B2 | | 11/2003 | Osborn et al. | |
| 6,654,316 B1 | | 11/2003 | Butler et al. | |
| 2002/0043897 A1 | * | 4/2002 | Dunn et al. | 310/337 |

OTHER PUBLICATIONS

Multimode Directional telesonar Transducer Proc. IEEE Oceans, v2, 1289–1292 (2000).

* cited by examiner

*Primary Examiner*—Ian J. Lobo
(74) *Attorney, Agent, or Firm*—David M. Driscoll

(57) ABSTRACT

An electro-mechanical transducer is disclosed, which provides a wideband response by activating successive multiple resonant frequencies in a way which provides additive output between the resonant frequencies. A three mode wideband high output transducer is also disclosed along with an electro-mechanical feedback system which provides a smoothed response as well as array control under multiple element usage.

24 Claims, 6 Drawing Sheets

MULTIPLY RESONANT WIDEBAND TRANSDUCER APPARATUS

BACKGROUND OF THE INVENTION

1. Field of the Invention

The present invention relates in general to transducers, and more particularly to acoustic transducers. The present invention also relates to a transducer capable of radiating acoustic energy over a wide band of frequencies. More particularly, the present invention relates to an acoustic transducer that may be provided with an electro-mechanical feedback system.

2. Background and Discussion

Normally electro-acoustic underwater transducers are operated in the vicinity of the fundamental resonant frequency. Maximum output is obtained at the resonant frequency; however, operation in the vicinity of this frequency limits the bandwidth of the transducer. Wideband performance can be obtained above resonance but the band is often limited by the next overtone resonance. Because of phase shifts, the presence of this overtone resonance generally creates a cancellation between the two resonant frequencies typically resulting in a significant reduction, or notch, in the level of the response, thus limiting the bandwidth.

It is a general object of the present invention to provide a transduction apparatus, which eliminates the reduction in the level of response, attaining a wide bandwidth above the fundamental resonance through in-phase addition in the response between the fundamental and overtone resonant frequencies.

Another object of the present invention is to provide a transduction apparatus which uses the harmonic or overtone resonant frequencies to provide broadband electromechanical coupling.

A further object of the present invention is to provide electro-mechanical feedback control resulting in an improved response under single element and array loading conditions.

SUMMARY OF THE INVENTION

To accomplish the foregoing and other objects, features and advantages of the invention there is provided an improved electro-mechanical transduction apparatus that employs a system for utilizing the electro-mechanical driver in a way so that there is additive output between the resonant frequencies and furthermore may employ electromechanical feedback as a means for a smooth response.

In accordance with the invention there is provided an electro-mechanical transduction apparatus that is comprised of an electromechanical drive, and a transmission line. The drive is located in the transduction system so as to excite the consecutive extensional modes of vibration in a cooperative way producing an ultra wideband response as a projector and/or as a receiver. Other parts of the apparatus may include a piston head mass, a tail mass and a feedback system for providing a smooth response.

In accordance with one aspect of the invention there is provided an electro-mechanical transduction apparatus comprising; a transduction drive means having moving ends, means connecting the transduction drive means at one moving end to a tail section and an acoustic transmission line on the other end with means connecting the transmission line to a load and means for exciting said transduction drive means to cause the excitation of at least two multiple resonant frequencies with addition thereof between the multiple resonant frequencies, thus providing a wideband null free response from below the first resonance to at least above the second resonance.

In accordance with another aspect of the invention there is provided an electro-mechanical transduction apparatus comprising; a transduction drive member having moving ends; an acoustic transmission line coupled to one end of the transduction drive member; and a source for exciting the transduction drive member to cause the excitation of at least two multiple resonant frequencies without a null between the multiple resonant frequencies providing a wideband response from below the first resonance to at least above the second resonance.

In accordance with still another aspect of the invention there is provided a method of electro-mechanical transduction comprising the steps of: providing an electro-mechanical drive member coupled with a section of acoustic transmission line; exciting the electro-mechanical transduction member to cause the excitation of at least two multiple resonant frequencies, wherein the excitation further causes the addition of the at least two multiple resonant frequencies so as to provide a wideband and null free response in a range from below the first resonance to at least above the second resonance.

The drive system, such as a stack of piezoelectric ceramic (or, single crystal, electrostrictive or magnetostrictive) material, may typically take the form of extensional bars, discs, rings or cylinders. An electrically insulated piezoelectric ceramic (or single crystal, electrostrictive or magnetostrictive) sensor is located within the driver stack if the feedback system is activated. If an electric field drive and piezoelectric sensor type is used, an additional integrator or differentiator is necessary to provide a require 90 degree phase shift. If a magnetic field drive material, such as magnetostrictive material, is used and piezoelectric sensor type is used no additional 90 degree phase shift is required. Also if an electric field driver and a magnetically biased magnetostrictive sensor are used, there is no need for an integrator or differentiator since the output is proportional to the velocity and has an inherent 90 degree phase shift compare to an electric field sensor. Since the output is from a pickup coil there is no need for electrical insulators. There may be a need for a permanent magnet if the magnetostrictive material is not pre-polarized.

The acoustic radiating piston may typically take the form of a circular, square or rectangular, flat, curved or tapered piston and would be in contact with the medium while the remaining part of the system may be enclosed in a housing to isolate these parts from the medium. An enclosure or housing may not be necessary if the system is used as an electromechanical actuator or valve. The actuator load or the piston would be connected to the point of greatest motion or force.

In one embodiment of the invention a piezoelectric stack of circular plates or rings is used to drive a solid cylinder acting as a transmission line terminated in a load such as the water medium. In a further embodiment a heavy tail mass is added to the free end of the piezoelectric stack. In another embodiment a piston head mass is added between the transmission line and the load. Finally a piezoelectric sensor is added to the electromechanical drive along with a feedback amplifier, phase shifter and summing circuit for feedback control of the major resonance of the system. The back surface of an acoustic radiating piston and the drive or tail section would normally, but not always, be enclosed by a housing, shielding this motion from the intended radiating medium, such as water or air.

Although these embodiments illustrate means for acoustic radiation from a piston, alternatively, a mechanical load can replace or be connected to the piston and in this case the transducer would be an actuator. As a reciprocal device, the transducer may be used as a transmitter or a receiver and may be used in a fluid, such as water, or in a gas, such as air.

BRIEF DESCRIPTION OF THE DRAWINGS

Numerous other objectives, features and advantages of the invention should now become apparent upon a reading of the following detailed description taken in conjunction with the accompanying drawings, in which.

DETAIL DESCRIPTION

In accordance with the present invention, there is now described herein a number of different embodiments for practicing the present invention. In the main aspect of the invention there is provided a longitudinal electro-acoustic transducer for obtaining ultra wide bandwidth by structuring the relationship between the length and position of the drive stack and the transmission line which couples the drive stack to the radiating medium. In accordance with the present invention there is also provided an optional acoustic sensor and feedback system which provides a smooth controlled single element and array transmitting and receiving response. The sensor is positioned at a location in the drive stack for maximum sensitivity to the desired mode and minimum sensitivity to other modes that could cause unwanted in-phase feedback oscillation.

Figure 1A:
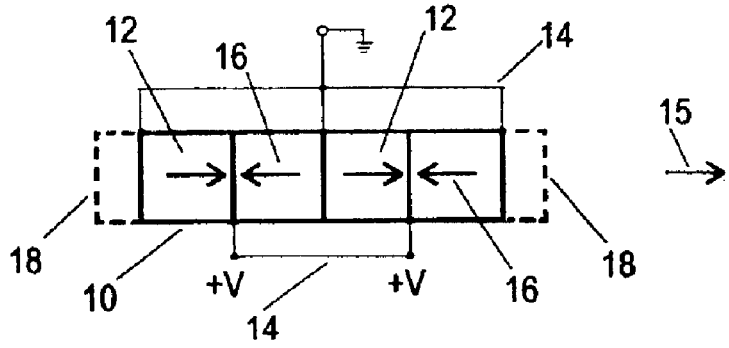
FIG. 1*a* schematically illustrates a transmission line transducer symmetrically excited by piezoelectric elements arranged for exciting odd numbered modes.
Figure 1B:
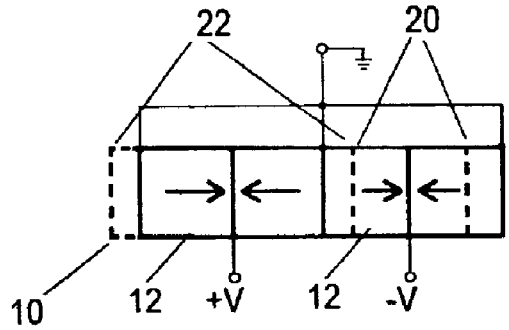
FIG. 1*b* schematically illustrates a transmission line transducer anti-symmetrically excited by piezoelectric elements arranged for exciting even numbered modes.
Figure 1C:
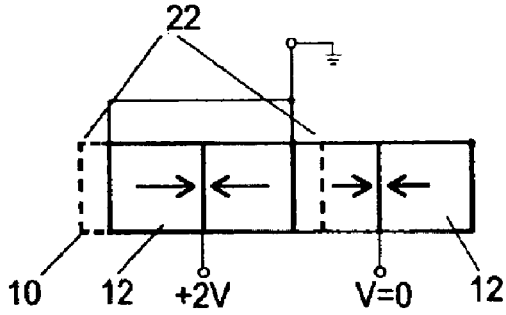
FIG. 1*c* schematically illustrates a transmission line transducer asymmetrically excited by piezoelectric elements arranged for exciting both odd and even number modes of vibration with zero voltage applied to one-half of the active material.
Figure 1D:
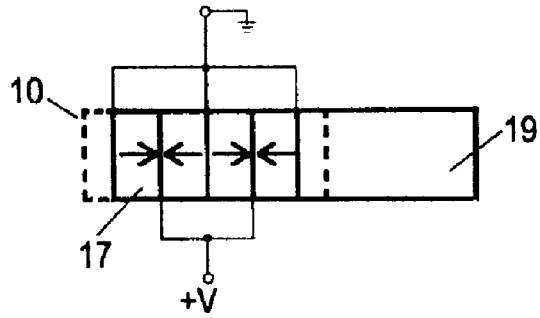
FIG. 1*d* schematically illustrates a transmission line transducer asymmetrically excited by piezoelectric elements arranged for exciting both odd and even number modes of vibration where the zero voltage section of FIG. 1*c* has been replaced by an electrically inactive transmission line.
Figure 2A:
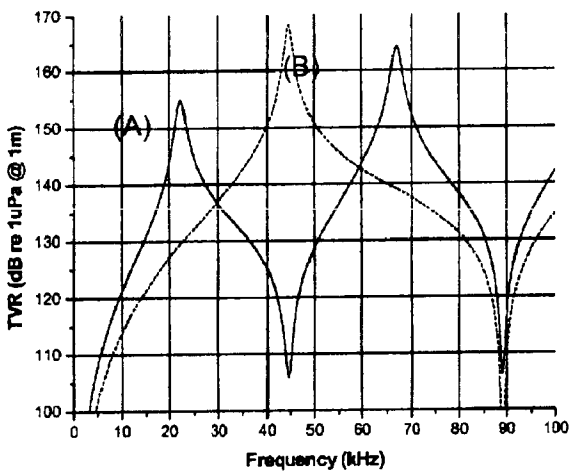
FIG. 2*a* illustrates the acoustic pressure transmitting voltage response, TVR, amplitude in dB for (A) symmetrical odd numbered modes and (B) anti-symmetric even numbered modes.

The operation of the transducer may be understood by referring to FIGS. 1*a*, 1*b*, 1*c* and 1*d* which illustrate the physical models and FIGS. 2*a* through 2*d* which illustrate the calculated resulting acoustic pressure amplitude and phase response. FIG. 1*a* illustrates a piezoelectric longitudinal bar resonator 10 operating in the piezoelectric 33-mode and composed of four separate piezoelectric elements 12 wired in parallel as indicated by the disclosed conductors 14 and polarized, as shown by arrows 16, for additive motion in the longitudinal direction 15. The dashed lines 18 illustrate the symmetrical displacement of the bar 10 for a voltage +V. The fundamental resonance occurs when the bar is one-half wavelength long and the next harmonic occurs when the bar is one wavelength long, but this cannot be excited by the voltage arrangement of FIG. 1*a*. Because of the electrical symmetry, only the first half-wavelength fundamental resonance and all the odd harmonics are excited, but not the even harmonics. If $f_1$ is the fundamental half wavelength resonance, then the odd harmonic frequencies are $f_{2n-1}=(2n-1)f_1$ for n=1, 2, 3, . . . The amplitude response of the acoustic pressure to the right of the bar is shown in FIG. 2*a* by the curve labeled (A) showing a fundamental resonance at 22.5 kHz and a third harmonic resonance at 67.5 kHz and a strong null at 45 kHz which is also the frequency of the second harmonic, but cannot be excited by the arrangement of FIG. 1*a*. The null at approximately 45 kHz is particularly deep because the phase of the mass controlled region of the fundamental is 180 degrees out of phase with the phase of the stiffness controlled region of the third harmonic resonant leading to a cancellation. The occurrences of these nulls limit the usefulness of such a system to provide a wideband response. The invention provides a means and method for adding a resonant response at these nulls in a constructive way using the even harmonics.

Figure 2B:
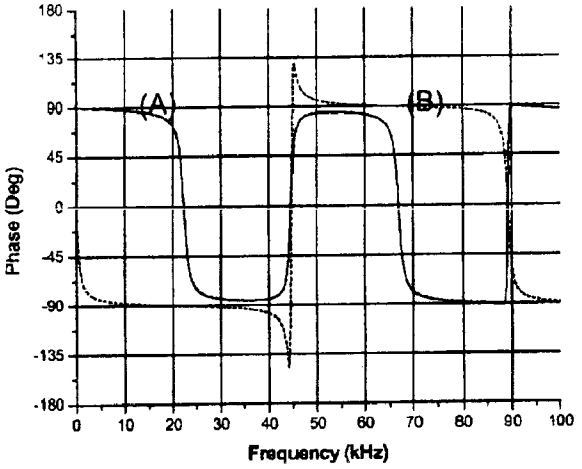
FIG. 2*b* illustrates the acoustic transmitting phase response in degrees for (A) symmetrical odd numbered modes and (B) anti-symmetric even numbered modes.

The even harmonics (but not the odd) are excited by the arrangement of FIG. 1*b* where the polarity of the voltage, V, on the right hand pair of elements is reversed. This causes a contraction on the right element pair while the left element pair expands. This is illustrated in FIG. 1*b* by the respective ranges 20 and 22. The excited even harmonic resonances are given by $f_{2n}=(2n)f_1$ for n=1, 2, 3, . . . The first even harmonic acoustic pressure amplitude response is plotted as curve (B) in FIG. 2*a* and seen to resonate at approximately 45 kHz which is just the location of the null for the wiring arrangement of FIG. 1*a*. The even harmonic motion on the right side of the bar is 180 degrees out of phase with the first odd harmonic mode as may readily be seen by comparing the displacements at 18 of FIG. 1*a* with the displacements at range 20 of FIG. 1*b*. The corresponding phase response is illustrated in FIG. 2*b* showing out of phase nature at low and high frequencies but in-phase motion at mid frequencies from 30 kHz to 60 kHz. It is because of the additional phase shift of FIGS. 1*a* and 1*b* that yields the ultimate in-phase condition at mid band which allows the constructive addition of the even harmonics of FIG. 1*b* to the odd harmonics of FIG. 1*a* if the two systems are added.

Figure 2C:
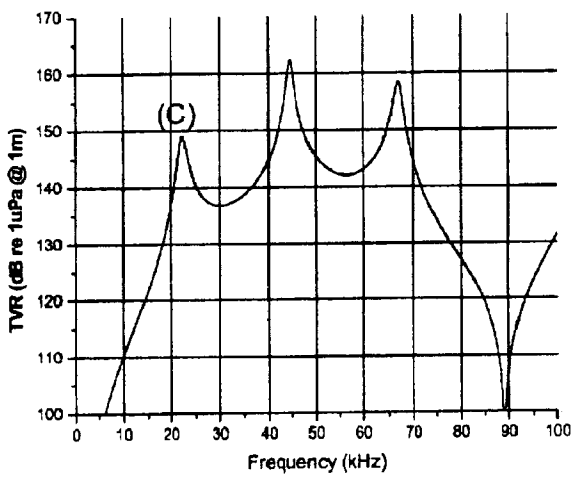
FIG. 2*c* illustrates the acoustic pressure transmitting voltage response, TVR, amplitude in dB for (C) asymmetric drive resulting in both odd and even number modes of vibration.
Figure 2D:
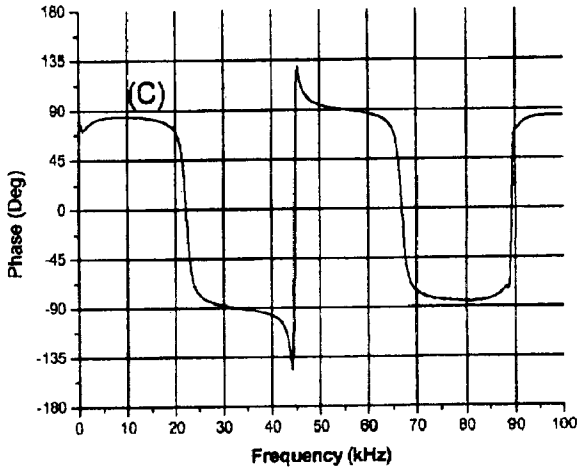
FIG. 2*d* illustrates the acoustic transmitting phase response in degrees for (C) asymmetric drive resulting from both odd and even number modes of vibration.

The sum of the voltage conditions of FIGS. 1*a* and 1*b* leads to the condition illustrated in FIG. 1*c* showing 2V volts on the left piezoelectric pair and 0 volts on the right piezoelectric pair. Since the V=0 voltage drive section is no longer active in generating a displacement it may be replaced by the electrically inactive transmission line section 19 as shown in FIG. 1*d*. (Also shown in FIG. 1*d* is a reconfigured drive section with elements 17 of half thickness for the same strain as FIG. 1*c* but with 1 volt drive as in FIGS. 1*a* and 1*b*.) The wideband acoustic pressure amplitude response for the cases of FIG. 1*c* or 1*d* are given in FIG. 2*c* showing the addition of the even harmonic resonance at 45 kHz filling in the original null with no nulls between the resonances as desired. The resulting phase response, shown in FIG. 2*d*, is the selective result of the two phase curves of FIG. 2*b* as determined by the amplitude of the corresponding harmonic response. The harmonic frequencies for this case are $f_n=(n)f_1$ for n=1, 2, 3, . . . The first null now appears in the vicinity of 90 kHz at twice the frequency of the 45 kHz null for the original case of FIG. 1*a* and thus doubling the bandwidth. This null occurs when the left hand piezoelectric pair is one wavelength long. The transducer now resonates in its fundamental mode, its second harmonic mode and its third harmonic. The bandwidth can be increased by reducing the proportional length of the active piezoelectric section allowing the excitation of higher harmonic modes such as the fourth, fifth and sixth modes, thus allowing an ultra wide bandwidth.

This invention provides a means for the addition of both odd and even modes yielding a wideband response of multiple resonances without destructive interference which would result in nulls. Each mode has an associated electromechanical coupling coefficient allowing a distribution of coupling over the frequency band improving the wideband effective electromechanical coupling coefficient of the transducer.

Figure 3:
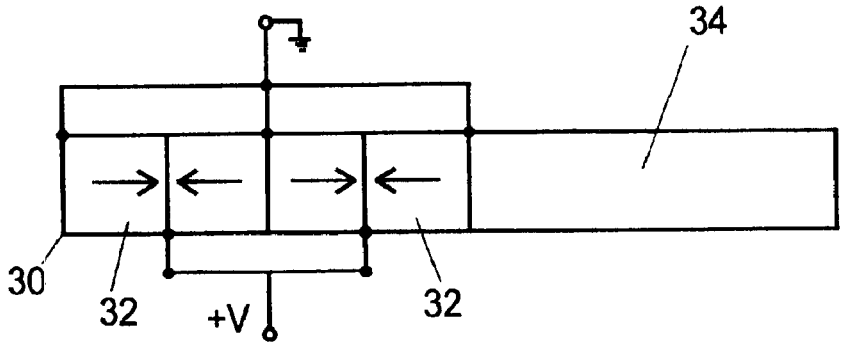
FIG. 3 illustrates a piezoelectric ceramic stack of four elements driving a transmission line for asymmetric drive, consecutive mode excitation.

FIG. 3 is a result of the teachings associated with FIGS. 1*a* through 1*d* and illustrates a configuration which, by way of the arguments of FIGS 1*a* through 1*d*, allows the addition and coexistence of both even and odd modes. FIG. 3 illustrates a piezoelectric ceramic stack 30 of four elements 32 driving a transmission line 34 for asymmetric drive, consecutive mode excitation. Although four elements are illustrated, a larger number may be used provided that the total length of the active drive section remains the same. The electrically inactive section (transmission line 34) to the right of the piezoelectric section (of four elements 32) may be constructed from any acoustically satisfactory material, and connected as illustrated in FIG. 3. A material that matches the impedance between the piezoelectric ceramic material and the medium, such as water, would be one example. The conditions of FIG. 1*c* may be ideally simulated with other inactive materials if the length is made one-quarter of a wavelength at the frequency at which the active section is one-quarter of a wavelength long. Accordingly, one may interpret the first resonant frequency of FIG. 2*c* as the quarter wavelength resonance of the inactive section, the second resonant frequency as the half-wavelength resonant frequency of the piezoelectric ceramic section and a pass through half wavelength section of the inactive section and the third resonant frequency as the third harmonic of the quarter wavelength inactive section.

The broadband response obtained from the multiple resonant transducer system has added benefit over transducers which simply operate above their fundamental resonant frequency. The benefit arises in the region of the additional resonant frequencies where now there is significant effective electromechanical coupling allowing improved power factor performance over an extended bandwidth rather than just at the fundamental resonance.

Figure 4:
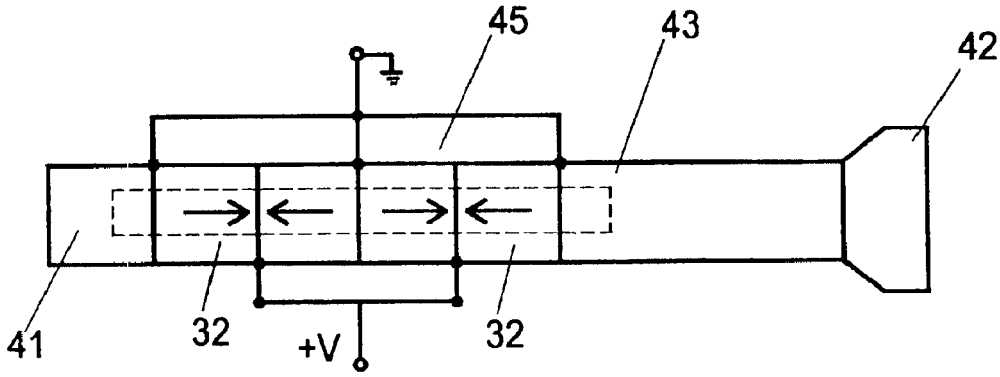
FIG. 4 illustrates a piezoelectric stack with a compression stress rod and tail mass driving a transmission line, and with a head mass for consecutive mode excitation.
Figure 5:
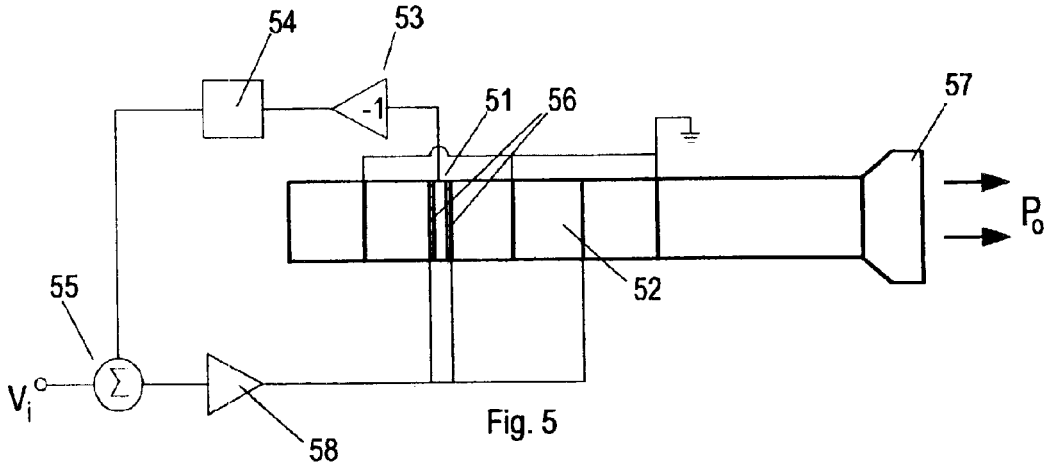
FIG. 5 illustrates a piezoelectric stack with a tail mass and a stress rod driving a transmission line with a head mass for consecutive mode excitation along with a feedback control system for smooth controlled transmission from input voltage $V_i$ to output acoustic pressure $p_0$.
Figure 7:
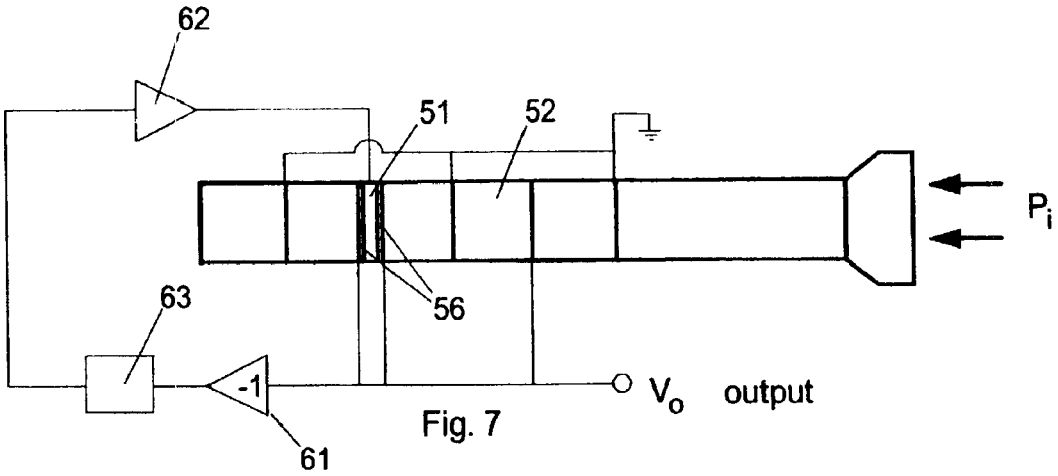
FIG. 7 illustrates the voltage receiving response from a piezoelectric stack with a tail mass and compression stress rod, transmission line with a head mass for consecutive mode excitation driven by an input acoustic pressure $p_i$ along with a feedback control system for transmission from input acoustic pressure $p_i$ to output voltage $V_0$.

Reference is now made to other embodiments of the present invention as illustrated in FIGS. 4, 5 and 7. The additions of a tail mass and/or head mass may be used to optimize the performance and change the conditions such that all the modes are no longer integer multiples of the fundamental and are, as such, not quite harmonics and are now so-called overtones. One such case is illustrated in FIG. 4 showing a tail mass 41, a head mass piston 42 and a stress rod 43 for applying compression to the piezoelectric ceramic material 45 for high power drive.

Feedback may be used to smooth the multi resonant response shown in FIG. 2*c* through the addition of a piezoelectric ceramic sensor and feedback system as illustrated in FIG. 5. The sensor 51 detects the stress in the electromechanical drive section 52 and converts it to an output voltage which is inverted and gain adjusted by inverter 53, integrated (or differentiated) by circuit 54 and summed by adder 55 with the input voltage $V_i$. The differentiation or integration (or 90 degrees phase shift) is used to produce a voltage which is proportional to the velocity, thus yielding a lossless feedback damping force. The sensor 51 is disposed between pairs of elements of the drive section 52, and is electrically insulated as indicate at 56 from the drive section 52. This lossless damping can also provide efficient transducer array control by providing a more uniform controlled array velocity distribution under array interacting conditions. The sensor 51 is located at a position which is sensitive to the center frequency mode which has the highest output but is also at a position where the stress is a minimum for the next strongest phase-reversed mode beyond the first null and above the band of interest. This location can be determined from calculation or finite element analysis. This optimum location minimizes positive self-oscillating feedback and allows greater lossless damping feedback gain.

Figure 6:
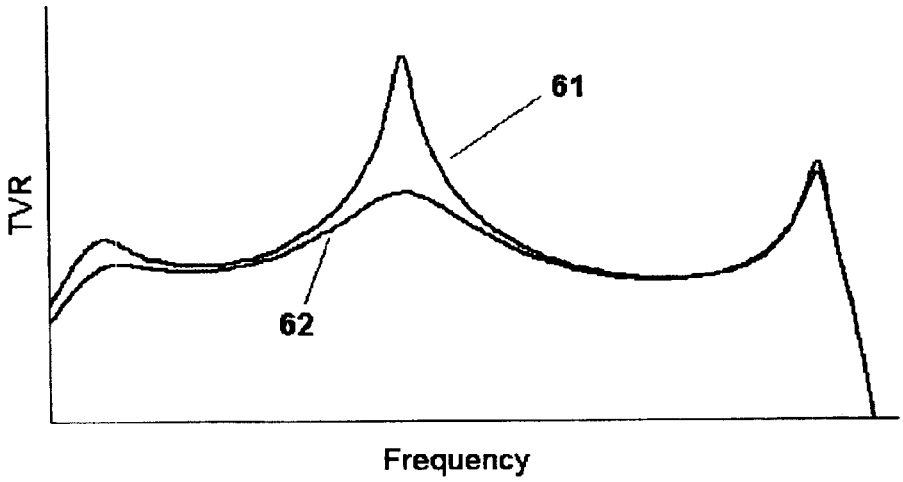
FIG. 6 illustrates the acoustic transmitting voltage response, TVR, without and with feedback.

The acoustic transmitting response, in dB, for a transducer with a diameter of approximately 0.75 inches, overall length of approximately 4 inches and piezoelectric stack length of 1.5 inches, is shown in FIG. 6 for the cases without feedback as indicted at 61 and with feedback as indicated at 62. The circuit of FIG. 5 may be simplified and the integrator or differentiator 54 may be replaced by a simple resistor-capacitor low pass or high pass RC network place directly across the output of the sensor 51.

Transducers are often used to both transmit and receive acoustic signals. The circuit of FIG. 5 may also be used to receive signals through the voltage output from the sensor 51 with the feedback circuit in place but without the input drive voltage $V_i$ activated; that is with $V_i$=0. Thus, to receive an acoustic wave impinging on piston 57 the drive voltage $V_i$ is turned off and the output receive voltage, $V_O$, is obtained from the sensor. With the drive voltage $V_i$ is set to zero, the received output voltage is sent through the feedback system through 53, 54 and 58 to proportionately activate the drive stack 52 and create a smooth receiving response.

Figure 8:
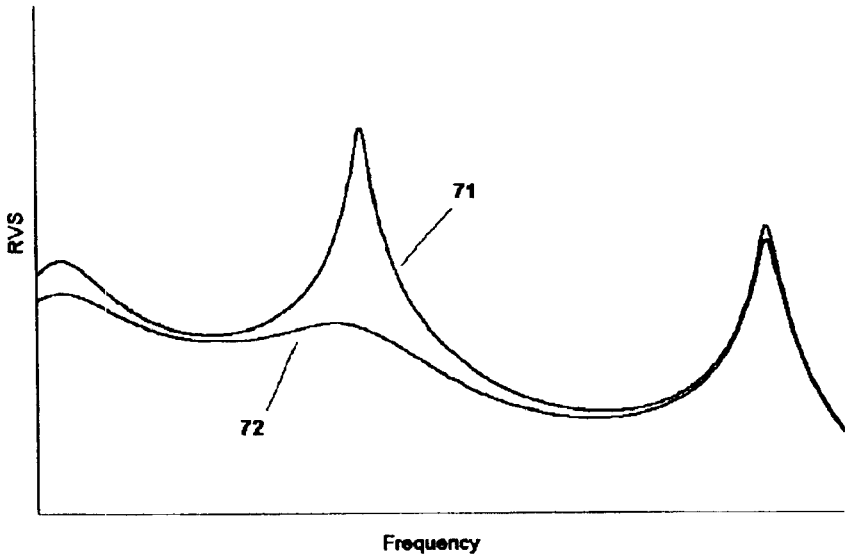
FIG. 8 illustrates the open circuit receiving voltage response, RVS, in dB without and with feedback.

An alternative receive system with feedback control is shown in FIG. 7 where the output voltage $V_0$ is taken from the original drive stack and the direction of the feedback amplifiers 61, 62 and phase shifter 63 have been reversed. The receive response corresponding to FIG. 7 without feedback as indicated at 71 and with feedback as indicated at 72, is shown in FIG. 8. The receive conditions may be automatically incorporated with transmit/receive diode switching with transformer and tuning network.

Figure 9:
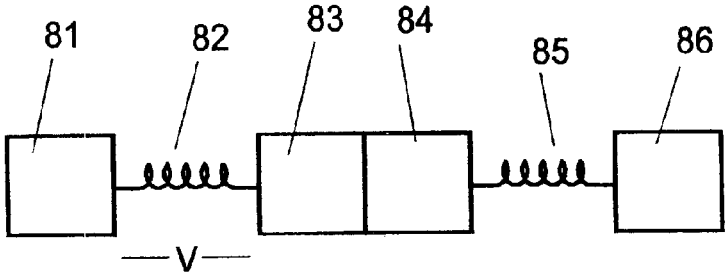
FIG. 9 illustrates a simple lumped mode representation with three degrees of freedom and two resonant frequencies.
Figure 10:
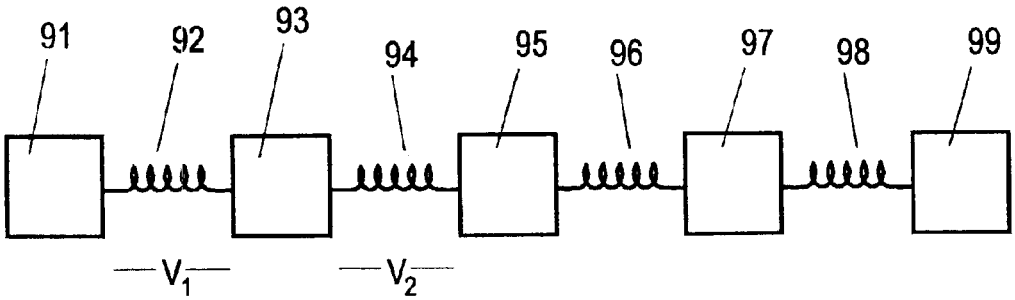
FIG. 10 illustrates a more extensive lumped mode representation with five degrees of freedom and four resonant frequencies.

The wide bandwidth transducer invention has been described in terms of a distributed electromechanical system or so called transmission line transducer. It may also be fabricated as, and approximately represented by, a lumped system composed of piezoelectric active springs, masses, and inactive springs and masses. The distributed system of FIG. 3 can be represented by the lumped system of FIG. 9 where the piezoelectric element is represented by the mass 81, spring 82, and mass 83, and the transmission line is represented by the mass 84, spring 85, and mass 86 with masses 83 and 84 connected together as one larger mass. This three degree of freedom system admits to only two resonant frequencies. The representation of FIG. 10, where the odd numbered elements (91, 93, 95, 97, 99) are masses and the even numbered (92, 94, 96, 98) are springs, admits to four resonant frequencies. If the piezoelectric voltages $V_1$ and $V_2$ are equal only the fundamental piezoelectric mode may be excited while the inactive springs 96, 98 and masses 95, 97, 99 may resonate at two frequencies. If $V_2$=0 then the piezoelectric section may also be excited into two resonant frequencies; and therefore, drive the transmission line at these frequencies. Thus, the invention originally described as a distributed system may also be constructed from a series of separate elements representing springs and masses. The invention is not limited to the number of elements shown and may be extended to a larger number resulting in a larger number of resonances and a wider bandwidth response. Electric field and magnetic field type transduction materials may be used.

Having now described a limited number of embodiments of the present invention, it should now become apparent to those skilled in the art that numerous other embodiments and modifications thereof are contemplated as falling within the scope of the present invention as defined in the appended claims.

What is claimed is:

1. An electro-mechanical transduction apparatus comprising; a transduction driver having moving ends, a tail section coupled to one end of the transduction driver, an electrically inactive acoustic transmission line distributed system on the other end of the transduction driver, the transmission line coupled to a load and a source for exciting said transduction driver to cause the excitation of at least two multiple resonant frequencies with the addition of both odd and even modes thereof between the multiple resonant frequencies, thus providing a wideband null free response from below the first resonance to at least above the second resonance.

2. An electro-mechanical transduction apparatus as set forth in claim 1 wherein there are three multiple resonant frequencies without nulls between the frequencies with a wideband response from just below the first resonance to just above the third resonance.

3. An electro-mechanical transduction apparatus as set forth in claim 2 wherein the numerical ratio of the third and first resonant frequencies is approximately 3 and the ratio of the second and first is approximately 2.

4. An electro-mechanical transduction apparatus as set forth in claim 1 wherein the limit on the upper bandwidth is set by a null which results from the condition of a one-wavelength length in the electromechanical drive section.

5. An electro-mechanical transduction apparatus as set forth in claim 1 wherein the multiple resonant frequencies are approximately related to the fundamental resonance by successive integer multiples.

6. An electro-mechanical transduction apparatus as set forth in claim 1 wherein the load is in the form of an acoustic radiating piston and medium that supports acoustic waves.

7. An electro-mechanical transduction apparatus as set forth in claim 1 wherein the electromechanical driver is piezoelectric ceramic, piezoelectric, electrostrictive, single crystal, magnetostrictive, ferromagnetic shape memory alloy or other electro-mechanical drive material or transduction system.

8. An electro-mechanical transduction apparatus as set forth in claim 1 wherein the transduction driver is in the form of plates, bars, rings or a cylinder operated in the 33 or 31 mode.

9. An electro-mechanical transduction apparatus as set forth in claim 1, which is compliantly mounted from the front, back or intermediate location near the interface between the electro-mechanical driver and the transmission line.

10. An electro-mechanical transduction apparatus as set forth in claim 1 wherein the load is a fluid or a mechanical or optical device and the apparatus Is an actuator.

11. An electro-mechanical transduction apparatus as set forth in claim 1 wherein the transmission line is composed of multiple sections tailored to the desired wave speed or impedance.

12. An electro-mechanical transduction apparatus as set forth in claim 1 wherein the transmission line is composed of multiple sections tailored to resonate at specific frequencies.

13. An electro-mechanical transduction apparatus as set forth in claim 1 wherein feedback is used to control the transmitting or receiving response of the multiple resonant transducer and provide a smoother response.

14. An electro-mechanical transduction apparatus as set forth in claim 1 wherein negative feedback is used to control the transmitting or receiving response of an array of multiple resonant transducers providing a smoother response and an array performance less affected by array interactions.

15. An electro-mechanical transduction apparatus as set forth in claim 13 wherein the feedback is provided by an electromechanical sensor which is piezoelectric or electrostrictive type material and is insulated and positioned within the electromechanical driver section for minimum sensor response from unwanted phase inverted higher order modes.

16. An electro-mechanical transduction apparatus as set forth in claim 13 wherein an integrator or differentiator or 90 degree phase shifter is used in the feedback to introduce lossless damping in the system.

17. An electro-mechanical transduction apparatus as set forth in claim 13 wherein the driver is piezoelectric and the electromechanical sensor is magnetostrictive type material which is pre-polarized or with a polarizing magnet and is positioned within the electromechanical driver section with a sensing coil for minimum sensor response from unwanted phase inverted higher order modes.

18. An electro-mechanical transduction apparatus as set forth in claim 13 wherein the driver is magnetostrictive and the electromechanical sensor is piezoelectric type material and is positioned within the electromechanical drive section for minimum sensor response from unwanted phase inverted higher order modes.

19. An electro-mechanical transduction apparatus as set forth in claim 1 wherein a compression bolt is used to compress the electro-mechanical drive stack.

20. An electro-mechanical transduction apparatus comprising;

a transduction drive member having moving ends; a tail section coupled to one end of the transduction drive member; an acoustic transmission line coupled to another opposite end of the transduction drive member; and a source for exciting said transduction drive member to cause the excitation of at least two multiple resonant frequencies, at least one an odd and one an even mode with addition of the modes between the multiple resonant frequencies, without a null between the multiple resonant frequencies providing a wideband response from below the first resonance to at least above the second resonance.

21. An electro-mechanical transduction apparatus as set forth in claim 20 wherein said transducer includes a means for feedback control.

22. An electro-mechanical transduction apparatus as set forth in claim 21 wherein the feedback sensor is embedded in the driving stack of said transducer.

23. An electro-mechanical transduction apparatus as set forth in claim 20 wherein said transducer source includes a means for receiving.

24. A method of electro-mechanical transduction comprising the steps of: providing an electro-mechanical drive member coupled with a section of electrically inactive acoustic transmission line; exciting said electro-mechanical transduction member to cause the excitation of at least two multiple resonant frequencies, at least one an odd and one an even mode, said excitation further causing the addition of said at least two multiple resonant frequencies so as to provide a wideband and null free response in a range from below the first resonance to at least above the second resonance.

* * * * *